US011859376B2

(12) United States Patent
Altunc et al.

(10) Patent No.: US 11,859,376 B2
(45) Date of Patent: Jan. 2, 2024

(54) WALL TYPE WATER DRAIN WITH ADJUSTER

(71) Applicant: EVI METAL INOKS YAPI URUNLERI MIMARLIK VE MUTEAHHITLIK INSAAT TAAHHUT SANAYI DIS TICARET LIMITED SIRKETI, Istanbul (TR)

(72) Inventors: Seyit Omer Altunc, Sultangazi/Istanbul (TR); Seyit Murat Altunc, Sultangazi/Istanbul (TR); Seyit Fatih Altunc, Sultangazi/Istanbul (TR)

(73) Assignee: Evi Metal Inoks Yapi Urunleri Mimarlik Ve Muteahhitlik Instaat Taahhut Sanayi Dis Ticaret Limited Sirketi, Arnavutkoy/Istanbul (TR)

( * ) Notice: Subject to any disclaimer, the term of this patent is extended or adjusted under 35 U.S.C. 154(b) by 247 days.

(21) Appl. No.: 17/606,608

(22) PCT Filed: Sep. 13, 2019

(86) PCT No.: PCT/TR2019/050752

§ 371 (c)(1),
(2) Date: Oct. 26, 2021

(87) PCT Pub. No.: WO2020/218984

PCT Pub. Date: Oct. 29, 2020

(65) Prior Publication Data

US 2022/0235541 A1 Jul. 28, 2022

(30) Foreign Application Priority Data

Apr. 26, 2019 (TR) ..... TR2019/06245

(51) Int. Cl.
*E03F 5/04* (2006.01)

(52) U.S. Cl.
CPC .... *E03F 5/0408* (2013.01); *E03F 2005/0412* (2013.01)

(58) Field of Classification Search
CPC ..... E03F 5/0408; E03F 2005/0412
(Continued)

(56) References Cited

U.S. PATENT DOCUMENTS

2021/0054612 A1* 2/2021 DiCasmirro ..... E03D 11/16

FOREIGN PATENT DOCUMENTS

CN 203270764 U 11/2013
EP 2333171 A1 6/2011
(Continued)

OTHER PUBLICATIONS

International Search Report and Written Opinion, issued by the International Searching Authority (ISA/TR) in PCT Application No. PCT/TR2019/050752 dated Jun. 12, 2020. 7 pages.

*Primary Examiner* — Lori L Baker
(74) *Attorney, Agent, or Firm* — Meunier Carlin & Curfman LLC

(57) ABSTRACT

A water drain for use in wet areas such as kitchens, bathrooms, toilets, terraces, balconies, gardens is provided. The drain allows the water to be evacuated to be conveyed to the sewer. The drain comprises an adjuster, positioned between the reservoir and the flange, which has the ability and room to move to the right, left and diagonally within the reservoir thanks to the travel clearance. The drain comprises a set positioned between the reservoir blank and the flange blank, which determines the travel limits of the adjuster by entering through such reservoir blank and the flange blank and surrounds the adjuster blank at at least one surface of such adjuster.

6 Claims, 8 Drawing Sheets

(58) Field of Classification Search
USPC ..... 4/612–614
See application file for complete search history.

(56) References Cited

FOREIGN PATENT DOCUMENTS

| | | | |
|---|---|---|---|
| TR | 201603245 | A2 | 2/2017 |
| TR | 201708236 | U | 8/2017 |
| WO | 2018100220 | A1 | 6/2018 |

* cited by examiner h
4.3
5.3
4
4.2
5 h
5
4.2
5.3
4.3

1
3

WALL TYPE WATER DRAIN WITH ADJUSTER

CROSS-REFERENCE TO RELATED APPLICATIONS

This application is a national stage application filed under 35 U.S.C. § 371 of PCT/TR2019/050752 filed on Sep. 13, 2019, which claims priority to Turkish Application No. TR2019/06245 filed on Apr. 26, 2019, the contents of both of which are incorporated herein by reference.

TECHNICAL FIELD

This invention relates to water drains which are used in areas with wet areas such as kitchens, bathrooms, toilets, terraces, balconies, gardens and allow the water to be evacuated to be conveyed to the sewer.

PRIOR ART

Water drains with strainer are composed of a cover, lower body and drain gully. When the lower body is concealed in the concrete, the upper body is placed on the lower body and functions as a strainer. The lower body of the wall type water drain with strainer is mounted on concrete floor on wet floors, by advancing a little inside the wall at upper section.

To ensure that the wastewater is easily discharged and to prevent the bottlenecks that may occur in the water drain; there are elements such as frame, cover, grill and hair trap on the lower body. In known embodiments of the prior art, there are wall type water drains produced in standard length as well as the system with adjustable length. However, there is no embodiment in prior art in which only the cover and/or frame can be shortened despite of having a standard chamber. This is because a cover with the same length as chamber is used in wall type water drain embodiments in prior art. In addition, the prior art does not involve the application of a dropper frame which directs the waste water and particularly small droplets to the reservoir.

The national patent document TR2016/03245, which is incorporated in the prior art, refers to a wall type water drain. Such water drain is composed of at least one frame channel extending from both sides of the dropper frame to the frame hole parallel to the ground, at least one frame hole providing for the transfer of waste water to the inclined part in the center or near the center of the dropper frame and a low banquet about min. 1 mm below the wet floor at the front of the frame channel. Long slot holes are left on the flange in order to avoid any differences in openings. Once the flange is adjusted to the ground, it is fixed at the appropriate location of the slot holes. By means of the said slot holes, the level differences that may occur between the flange, the ground and the reservoir are avoided. There is up-down, i.e. only one-axis movement in said water drain. Since the chamber and flange are fixed to the wall, it cannot be moved later. Level calculations of the flange and dropper frame must be performed precisely before mounting on the system. A seal end piece is used to adjust the level difference. The product in the relevant document is both costly and difficult to install.

The national utility model document TR2016/09829 in the prior art discloses a water drain with wide travel range with adjustable eccentric part. Such water drain has an annular opening with at east two opposite linear edges which are parallel to each other and an upper adjustment piece that can be moved forward and backwards within the linear channel between two side sets. This water drain is used for wall front applications on the ground and in confined spaces. An eccentric part, which moves depending on the upper adjustment part, is used.

PURPOSE OF THE INVENTION

The purpose of the invention is to create a high flow wall type water drain wherein the central leakages that my take place between the siphon fixed on the floor and the cover, level differences can be compensated, which can be positioned easily in areas close to walls.

The water drain developed to achieve the said objectives is composed of an adjuster positioned between the reservoir having a drainage opening at the bottom and the flange covering the openings that may occur between the dropper frame and such reservoir and travel clearance allowing movement of said adjuster.

DESCRIPTION OF FIGURES

Attached

Figure 1:
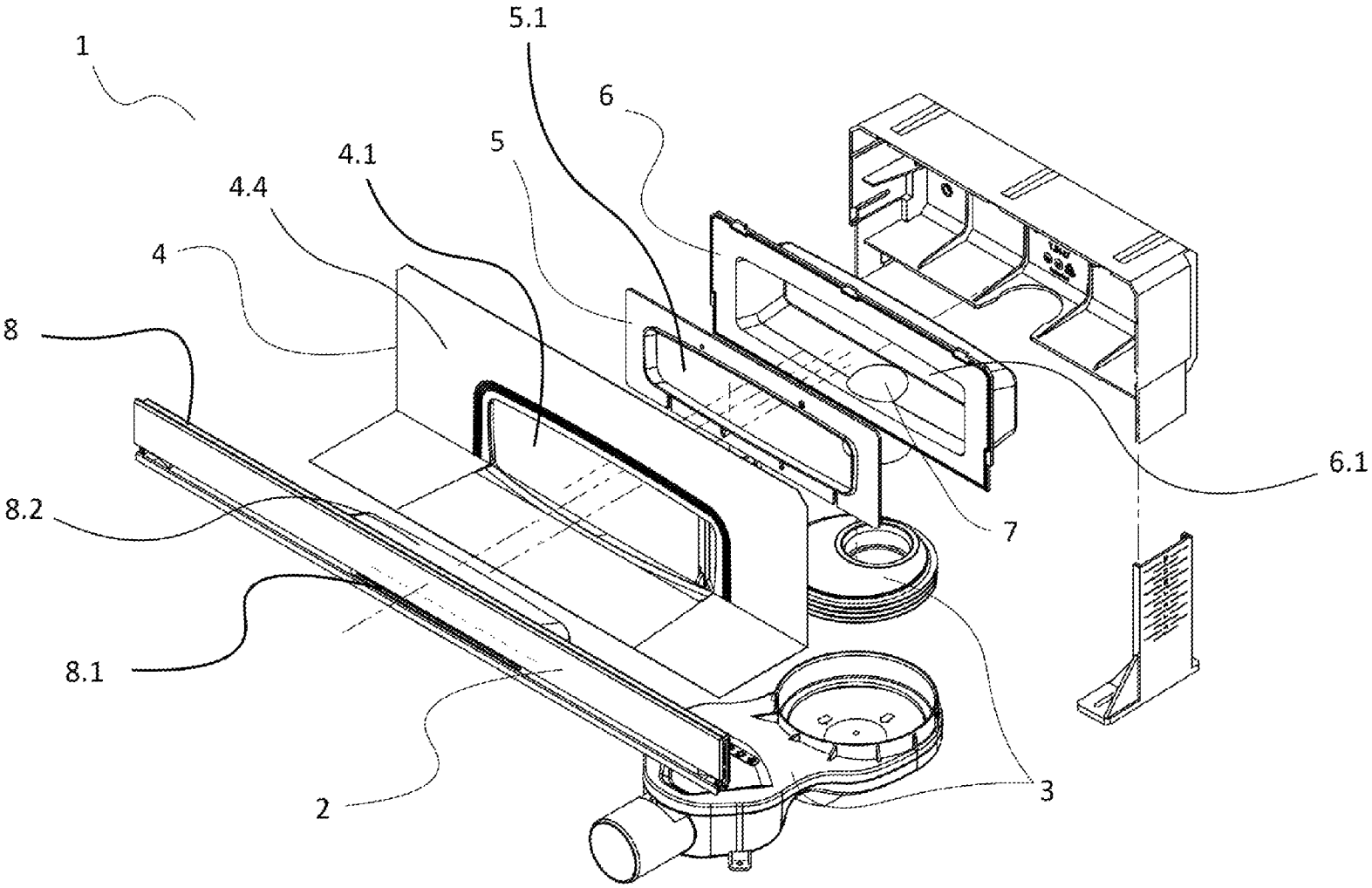
FIG. 1 is the top perspective view of the disassembled state of the water drain (1).
Figure 2:
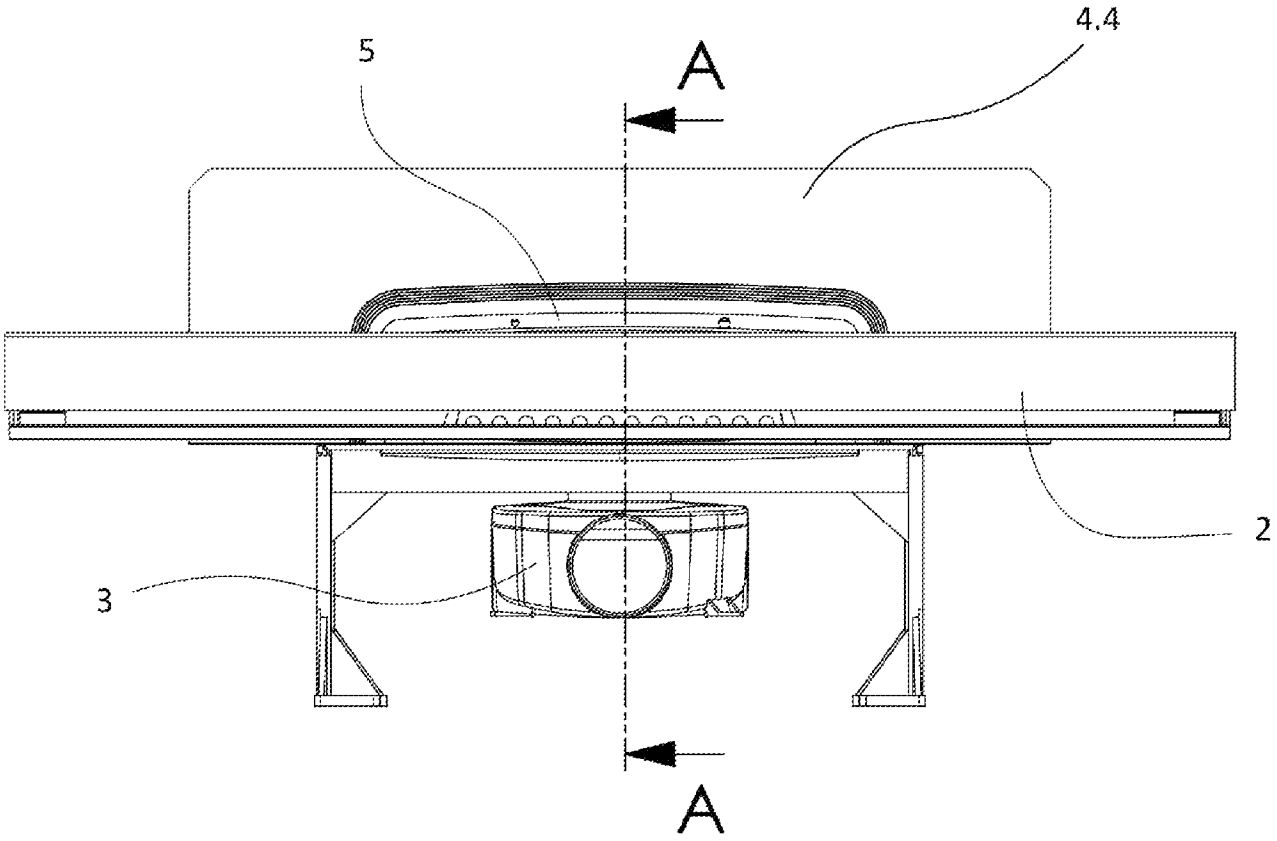
FIG. 2 is the front view of the water drain (1).
Figures 3, 4, 5:
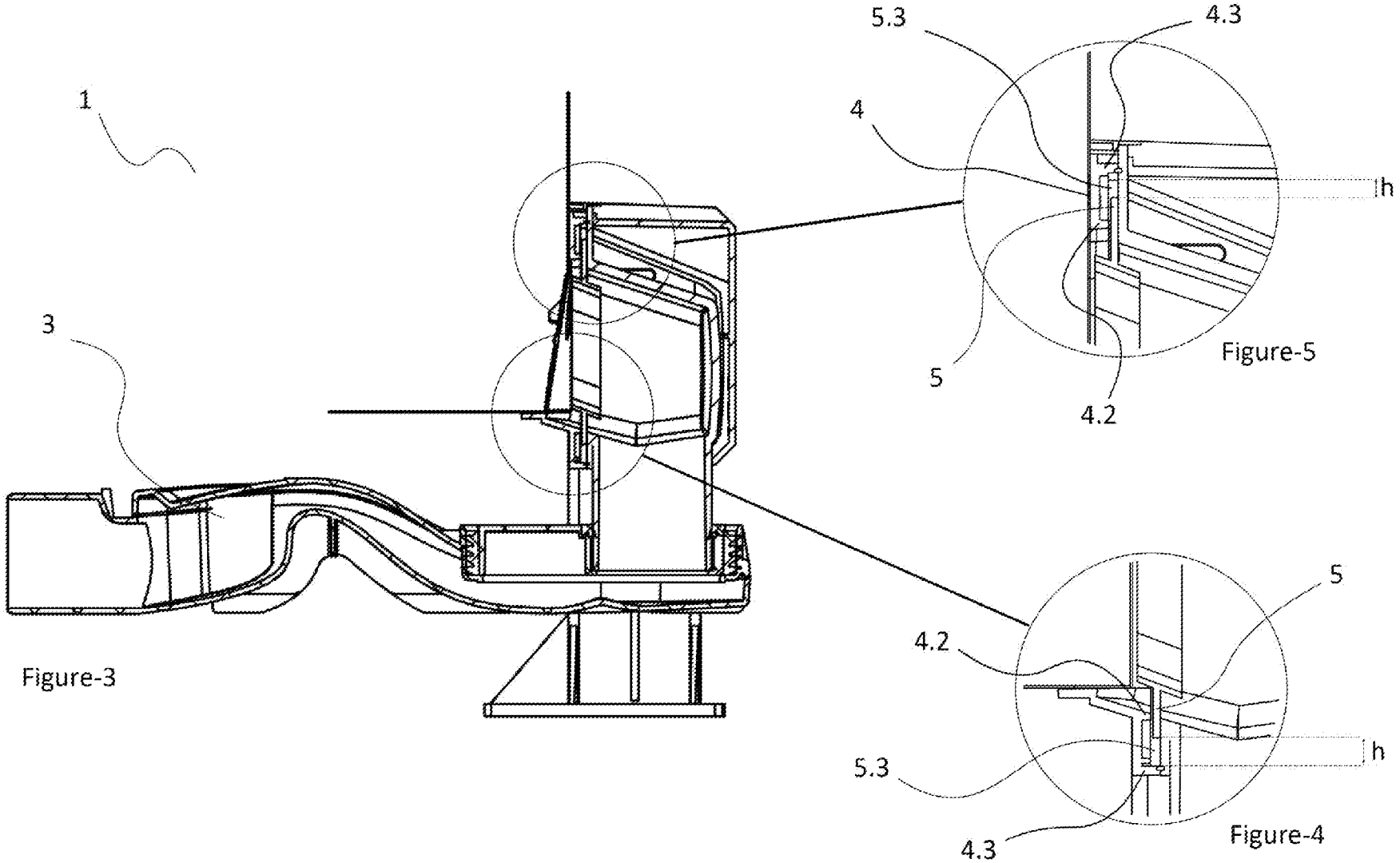
FIG. 3 is the A-A section view of the water drain (1).
FIG. 4 is a detailed view of AA section of the water drain (1).
FIG. 5 is a detailed view of the AA section of the water drain (1).
Figure 6:
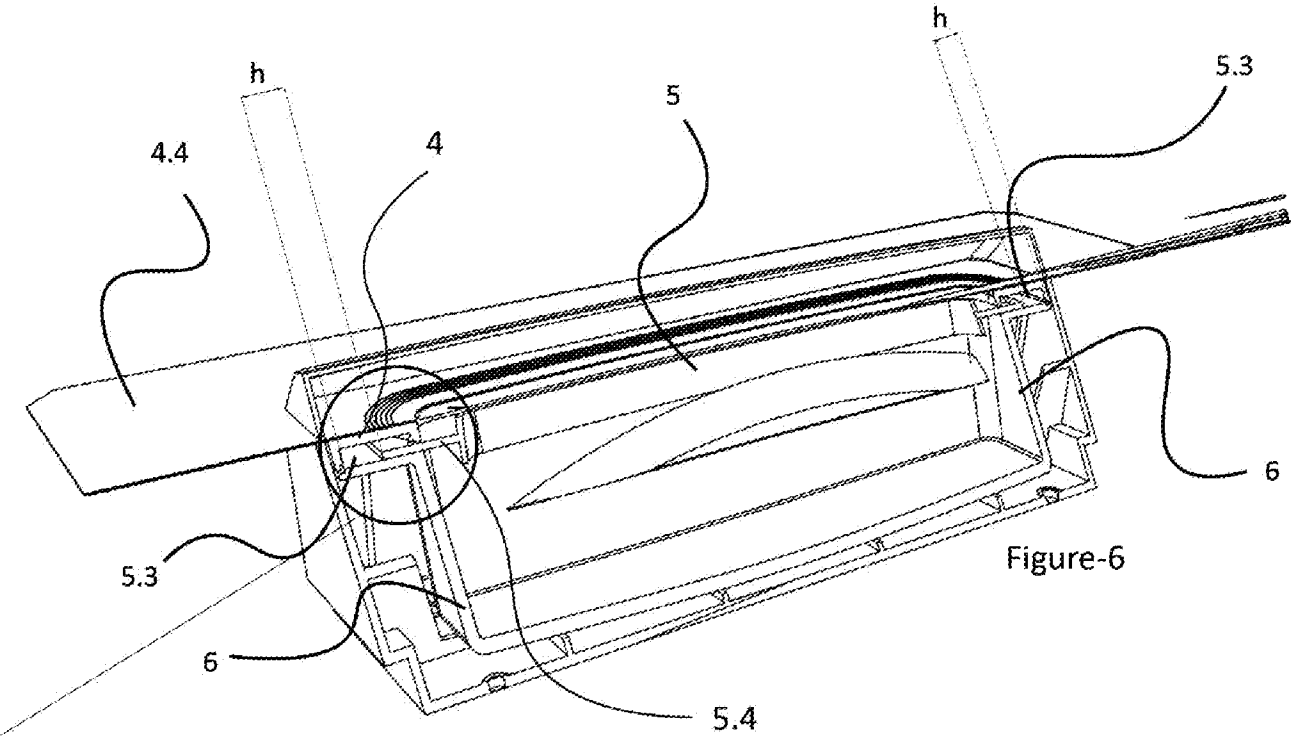
FIG. 6 is the perspective view of the cross section of the water drain (1).
Figure 7:
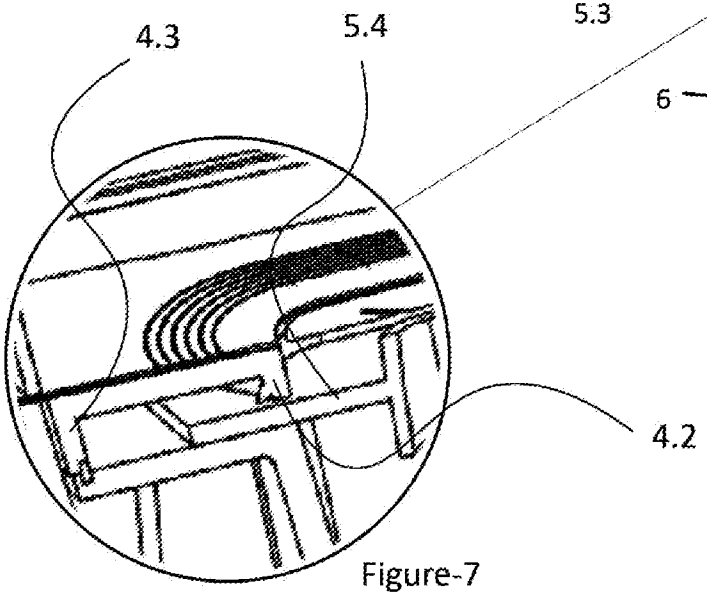
FIG. 7 is a detailed view of the cross section of the water drain (1).
Figure 8:
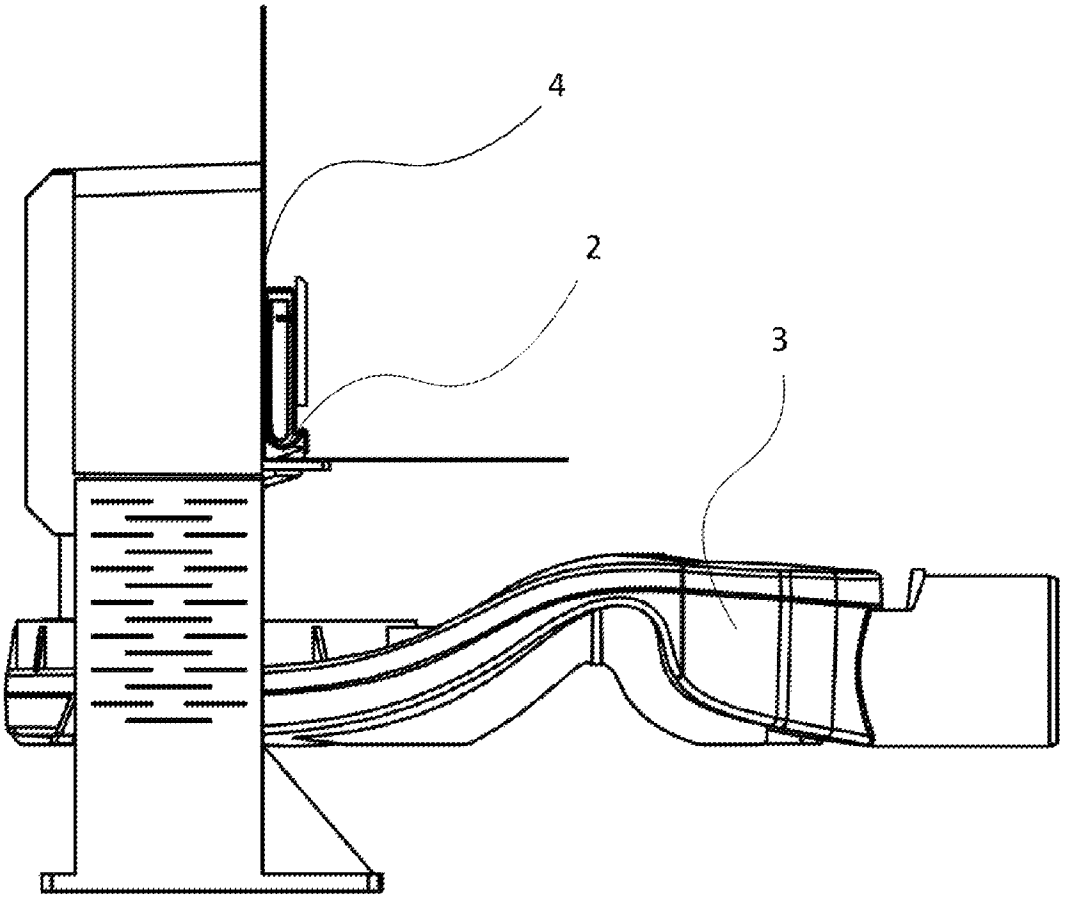
FIG. 8 is a side view of the water drain (1).
Figure 9:
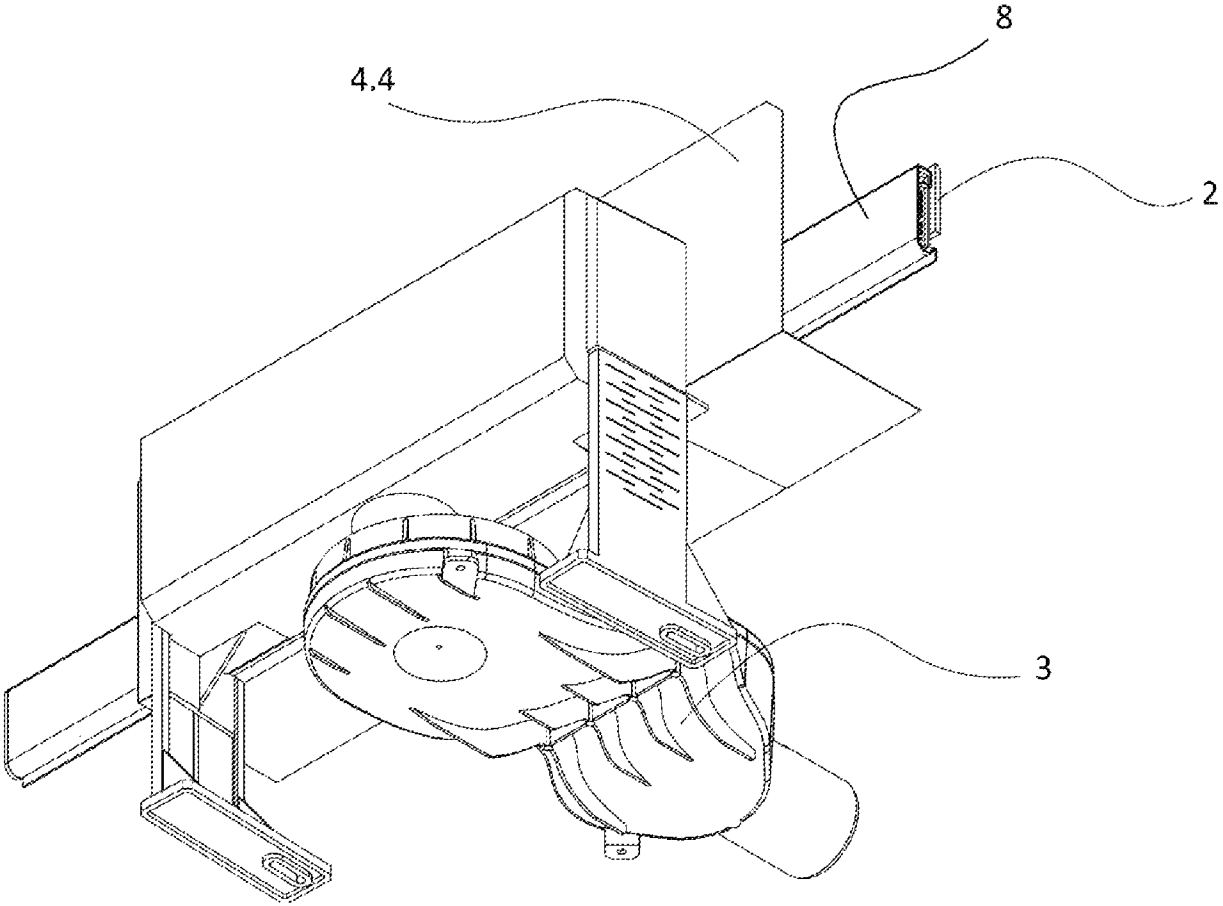
FIG. 9 is the bottom perspective view of the water drain (1).
Figure 12:
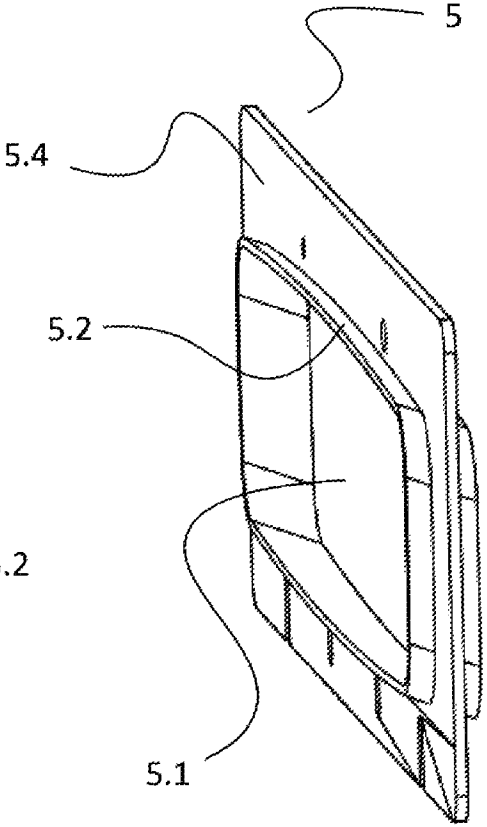
FIG. 12 is the rear perspective view of the adjuster (5).
Figure 11:
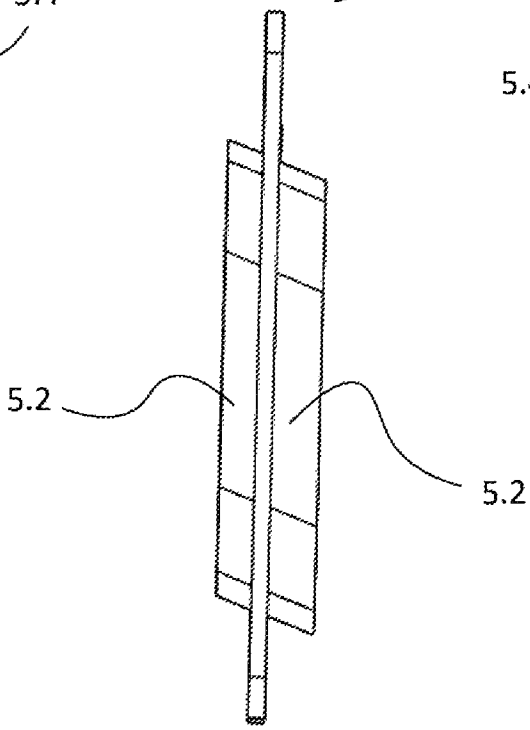
FIG. 11 is a side view of the adjuster (5).
Figure 10:
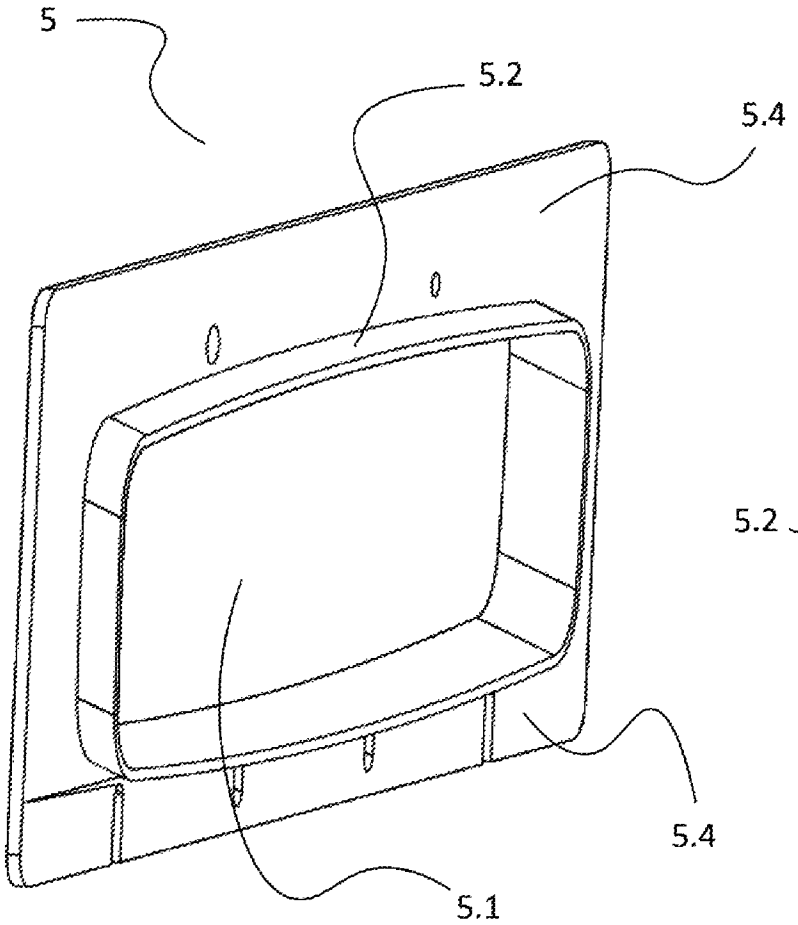
FIG. 10 is the rear perspective view of the adjuster (5).
Figure 13:
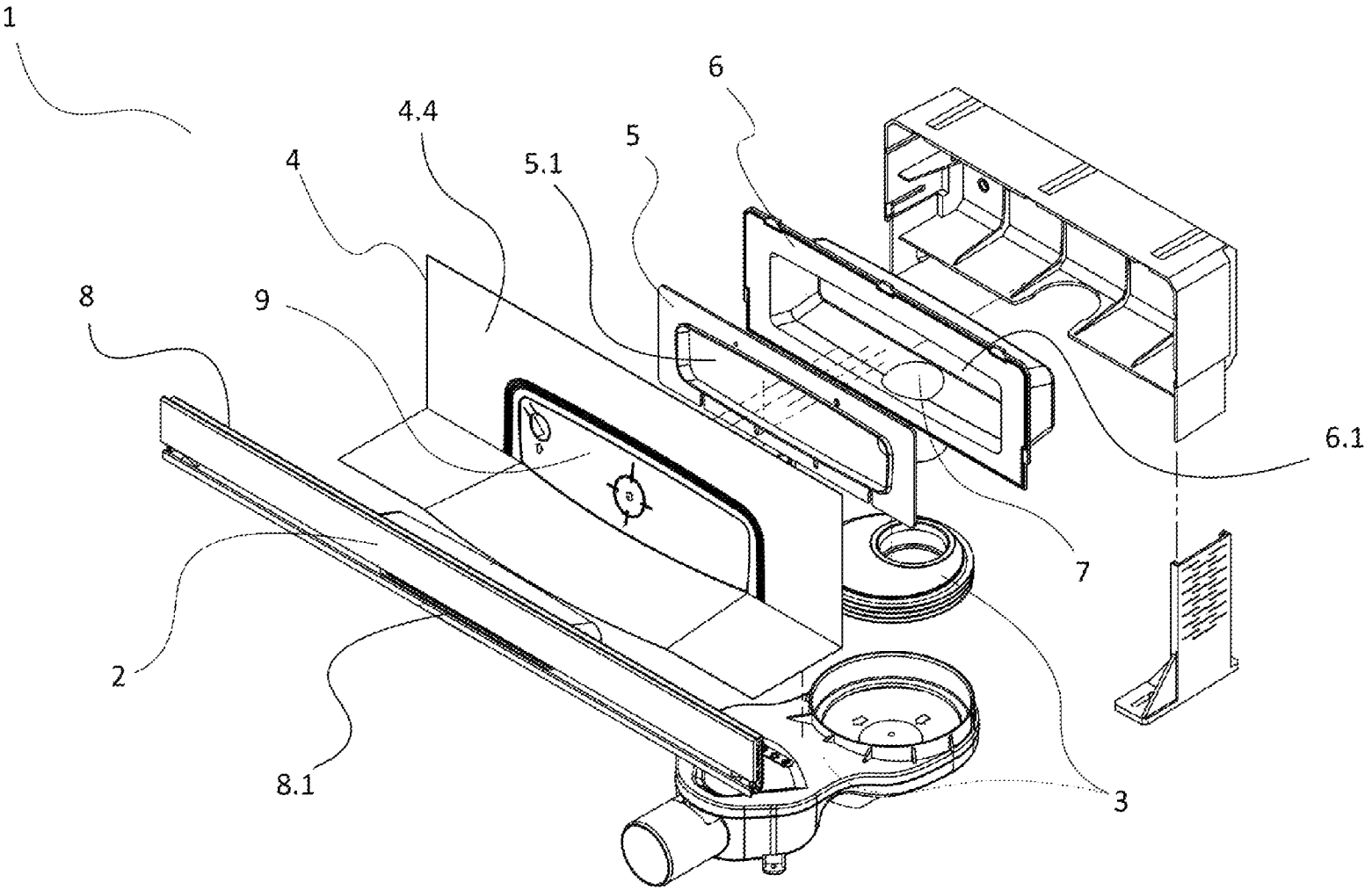
FIG. 13 is the top perspective view of the disassembled state of the water drain (1) with the protective cover (9).

Numbers and names of main parts mentioned in the figures are given below.

(1) Water Drain
(2) Cover
(3) Siphon
(4) Flange
(4.1) Flange blank
(4.2) Inner set
(4.3) Outer set
(4.4) Insulation membrane
(5) Adjuster
(5.1) Adjuster blank
(5.2) Set
(5.3) Movement clearance
(5.4) Adjuster edge
(6) Reservoir
(6.1) Reservoir blank
(7) Drainage hole
(8) Dropper frame
(8.1) Frame hole
(8.2) Curved piece
(9) Protective cover

DETAILED EXPLANATION OF THE INVENTION

The invention relates to water drains which are used in areas with wet areas such as kitchens, bathrooms, toilets, terraces, balconies, gardens and allow the water to be evacuated to be conveyed to the sewer. Said water drain (1) is composed of an adjuster (5) including a cover (2), a siphon (3), flange (4), flange blank (4.1), set (5.2) and adjuster edge (5.4), a reservoir (6) reservoir blank (6.1)), drain hole (7), dropper frame (8), frame hole (8.1) and curved piece (8.2).

Drainage hole (7) is located at the bottom of the reservoir (6). The water to be discharged is conveyed from the usage area to the siphon (3) through the drainage hole (7) and from the siphon (3) to the sewer. The siphon (3) positioned at the bottom of the reservoir (6) can move under the reservoir (6). After the reservoir (6) is fixed to the wall, the adjuster (5) and the flange (4) are assembled in sequence.

There is a cover (2) and a dropper frame (8) at the front visible part of the wall type water drain (1). The cover (2) is fixed on the dropper frame (8). The dropper frame (8) and the cover (2) are placed on the flange (4) and integrated into the system. In the rear part of the frame, there is a curved piece (8.2) which is integrated with the frame. Said curved piece (8.2) comprises a sheet holder. The curved piece (8.2) transmits water from the frame hole (8.1) to the reservoir (6).

The frame channel extends to the frame hole (8.1) on both sides of the dropper frame (8). The frame channel is a semicircular channel extending parallel to the ground. In alternative embodiments of the invention, the frame channel may be designed with one or more angular sections or in triangular, rectangular, elliptical or conical forms.

There is a low banquet in front of the frame channel. Low banquet is positioned at least 1 mm below the wet floor. Thanks to the low banquet, the dropper frame (8) is able to absorb waste water and especially small droplets and direct them into the reservoir (6). The frame hole (8.1) is located in or close to the center of the dropper frame (8). The frame hole (8.1) ensures that the waste water is transferred to the curved piece (8.2).

The flange (4) covers the openings that may occur between the dropper frame (8) and the reservoir (6). Because it has an elastic structure. It is fixed on the reservoir (6) through the slot holes. There is an insulating membrane (4.4) made of nonwoven fabric on the flange (4). Non-woven fabric is a technical textile material which is produced only for special uses, whether knitted or non-woven, and which is very low in cost compared to the usage period. Said fabric comprises a polyethylene film layer. Both the polyethylene film layer and the insulation membrane (4.4) provide waterproofing without any problem thanks to their own characteristics.

In an alternative embodiment of the present invention, the protective cover (9) is provided on the flange (4). The flange (4) and the protective cover (9) are obtained once in a single piece and are connected to each other at the joints. The joints are produced in the same mold in a single operation during the production of the flange (4) without requiring additional processing and molding. The joints consist of an attenuated channel, such as crimean and perforating applications used in printing, and/or sequential holes following an each other. In this way, easy and smooth tearing is ensured.

The adjuster (5) is located between the reservoir (6) and the flange (4). After the adjuster (5) is positioned on the reservoir (6), the flange (4) is positioned on said adjuster (5). Finally, the outer set (4.3) located in the flange (4) is welded to the reservoir (6) so that the flange (4) and the reservoir (6) are connected to each other. Said outer set (4.3) is longer than the inner set (4.2). There is a distance between the inner set (4.2) and the connection surface of the reservoir (6) and flange (4). Said distance is such that the edge (5.4) of the adjuster can be inserted. The travel range of the adjuster edge (5.4) is determined by the outer set (4.3); those of the set (5.2) is determined by the inner set (4.2).

When the reservoir (6) and the flange (4) are fixed to each other, the adjuster (5) which remains in between can move with slight force only. When the adjuster (5), which is slightly pressed between the reservoir (6) and the flange (4), is kept in the desired position, it retains its position. In this way, an additional part is not required during the assembly process of the water drain (1) according to the invention. In addition, the assembly is completed quickly as no additional work is performed.

In the middle of the adjuster (5), the adjuster blank (5.1) is provided. Said adjuster blank (5.1) is large enough to allow passing through of the curved piece (8.2). The curved piece (8.2) is directly connected to the dropper frame (8). Thus, the adjuster (5) can be moved by the dropper frame (8). In this way, by sliding the dropper frame (8) down-up and right-left, the level and balance of the water drain (1) can be adjusted.

There is a set (5.2) on the edge of the adjuster blank (5.1) located in the middle of the adjuster (5). The set has an inclined structure. Due to its inclined structure, it guides the flow of water to be discharged. Said set (5.2) passes into the reservoir (6) and determines the movement limits of the adjuster (5). On the other hand, another factor that determines the movement limits of the adjuster (5) is the travel clearance (5.3). The adjuster (5) is able to move right-left, up-down and transverse through the travel clearance (5.3). Assuming that the length of said travel clearance (5.3) is "h, the optimum value for "h" is 15 millimeters. In this way, the adjuster (5) is free to travel for 15 millimeters. In an alternative embodiment, the value "h" can vary from 5 to 25 mm. In other alternative embodiments of the invention, the dimensions given may vary.

The adjuster (5) is directly connected to the dropper frame (8). Installation is done by moving the dropper frame (8) up-down and right-left. In this way, the height differences of the dropper frame (8) and the reservoir (6) with respect to the ground can be covered by said adjuster (5). Thus, there is no need to make an accurate calculation for the material thickness and plaster thickness used on the ground. As a result, the installation process can be completed quickly and reliably without the need for precise thickness calculation.

A water drain which are used in areas with wet areas such as kitchens, bathrooms, toilets, terraces, balconies, gardens and allow the water to be evacuated to be conveyed to the sewer characterized in that; it comprises an adjuster (5), positioned between the reservoir (6) and the flange (4), which has the ability and room to move to the right, left and diagonally within the reservoir (6) thanks to the travel clearance (5.3) and a set (5.2), positioned between the reservoir blank (6.1) and the flange blank (4.1), which determines the travel limits of the adjuster (5) by entering through such reservoir blank (6.1) and the flange blank (4.1) and surrounds the adjuster blank (5.1) at at least one surface of such adjuster (5.).

The invention claimed is:

1. A water drain for use in areas with wet areas such as kitchens, bathrooms, toilets, terraces, balconies, gardens and to allow water to be evacuated to be conveyed to the sewer comprising an adjuster, positioned between a reservoir and a flange, such that due to a travel clearance it has ability and room to move to the right, left and diagonally within the reservoir; and a set, positioned between a reservoir blank and a flange blank, and configured to determine travel limits of the adjuster by entering through the reservoir blank and the flange blank and surrounds an adjuster blank at at least one surface of the adjuster.

2. The water drain of claim 1, wherein the travel clearance has an "h" value between 5-25 mm.

3. The water drain of claim 1, wherein the flange comprises an outer set which connects the flange with the reservoir and determines the travel limit of the adjuster.

4. The water drain of claim 1, wherein the flange comprises an inner set which determines boundaries of an area in which the set has a freedom of movement.

5. The water drain of claim 1, wherein the flange comprises an insulating membrane which forms s sealing bond between the reservoir and a dropper frame and covers openings that may occur and ensures a smooth completion of insulation.

6. The water drain of claim 5, wherein the insulation membrane is of a textile material containing a polyethylene film layer and made of nonwoven fabric.

* * * * *